United States Patent [19]

Takeshita et al.

[11] Patent Number: 4,555,264

[45] Date of Patent: Nov. 26, 1985

[54] PROCESS FOR PRODUCING STEEL FOR AN ELECTRICAL STEEL SHEET

[75] Inventors: Takeaki Takeshita; Katuyuki Ōba; Yoshiaki Shimoyama; Takashi Masuda, all of Kitakyushu, Japan

[73] Assignee: Nippon Steel Corporation, Tokyo, Japan

[21] Appl. No.: 411,552

[22] Filed: Aug. 25, 1982

[51] Int. Cl.[4] ..... C21C 7/06

[52] U.S. Cl. ..... 75/49; 75/57

[58] Field of Search ..... 75/49, 59, 57

[56] References Cited

U.S. PATENT DOCUMENTS

| | | | |
|---|---|---|---|
| 3,467,167 | 9/1969 | Mahin | 75/49 |
| 3,702,243 | 11/1972 | Miltenberger | 75/57 |
| 3,761,242 | 9/1973 | Finkl | 75/49 |

OTHER PUBLICATIONS

Tetsu-To-Magane, Journal of the Iron and Steel Institute of Japan, Special Issue: Secondary Steelmaking (Nov. 1977).

*Primary Examiner*—Peter D. Rosenberg

*Attorney, Agent, or Firm*—Cushman, Darby & Cushman

[57] ABSTRACT

The present invention relates to a process for producing an electrical steel sheet. In order to prevent aging deterioration of the electrical steel sheet, the carbon content of the steel for the sheet should be reduced to an extremely low level, e.g., 0.0030% or less. However, when molten steel was subjected to vacuum-degassing and continuous-casting procedures to prepare steel for a electrical steel sheet in a prior art, although a desired carbon content of the molten steel was ensured at the degassing stage, the carbon content of the steel sometimes exceeded the desired level at the slab range. In the present invention, the prior art problem is solved by carrying out the degassing procedure under conditions in which the ultimate degree of vacuum in the degassing vessel is 1.0 mmHg or less, the rate of inert gas blown per gas-blowing orifice is from 30 to 150 Nl/min, and the final carbon content of the molten steel is 0.0030% or less and by using means contacting the melt during the continuous-casting procedure, the carbon content of said means being 3.0% or less.

4 Claims, 3 Drawing Figures

PROCESS FOR PRODUCING STEEL FOR AN ELECTRICAL STEEL SHEET

TECHNICAL FIELD

The present invention relates to a process for producing steel for the production of an electrical steel sheet. The electrical steel sheet indicates oriented and non-oriented silicon steel sheets. More particularly, the present invention relates to a process for producing steel for an electrical steel sheet, the process comprising subjecting molten iron to refining, vacuum-degassing, and continuous-casting procedures so as to obtain a slab.

BACKGROUND TECHNIQUE

Generally, it is well known that the quality of an electrical steel sheet, which is used as the core material for electrical machinery, apparatuses, and the like, depends on such factors as so-called watt loss, magnetic flux density, orientation ratio, and aging deterioration, and, therefore, these factors are very important.

Among the above-mentioned factors, the term "aging deterioration" signifies a phenomenon in which the watt loss of an electrical steel sheet gradually deteriorates when the sheet is used for an extended period of time. One of the main causes of such deterioration is considered to be the residual carbon in the sheet.

Therefore, the starting material from which a non-oriented silicon-steel sheet is produced preferably has a carbon content of 0.0030% or less, as is disclosed in Japanese Patent Application No. 54-4785 previously filed by the applicant and entitled "Process for Producing a Non-oriented Silicon-Steel Sheet Exhibiting a Low Aging Deterioration and an Excellent Surface Property".

Heretofore, it was extremely difficult to attain a controlled carbon content of 0.0030% or less at the starting-material, i.e., the slab, stage. That is, even when it was possible to control the carbon content of the molten steel so that it did not exceed the desired value, e.g., 0.0030%, when decarburization was carried out during the melting stage by blowing an inert gas into the molten steel during the vacuum-degassing procedure. In the case of the ingot casting process, the molten steel picks up carbon from the mold stool when the molten steel is poured into the ingot mold. The resultant ingot solidifies in the ingot mold with large segregation of carbon.

Therefore, it was a common practice after hot-rolling or cold-rolling to decarburization-anneal the hot-rolled strip or the cold rolled strip so as to reduce the carbon content of the sheet to a desired value, e.g., 0.0030% or less. This decarburization-annealing of a hot-rolled strip or a product strip is called solid-phase decarburization. Said solid-phase decarburization results in a remarkable increase in the production cost as compared with liquid-phase decarburization at the molten steel stage. Moreover, solid-phase decarburization involves another problem in that depending upon the decarburization-annealing atmosphere, the surface of the steel sheet is oxidized, resulting in deterioration of the magnetic properties of the resultant electrical steel sheet.

If the [C] content of molten steel could be controlled so that it does not exceed the value of 0.0030% in the course of the production of a slab from molten steel, the above-mentioned problems could be solved in one stroke.

Recently, a continuous-casting process has been established as a process for producing a steel slab. The production of steel for producing an electrical steel sheet (hereinafter referred to as steel for an electrical steel sheet) has also been carried out in series in a steelmaking furnace (e.g., a converter), a vacuum-degassing apparatus, and a continuous-casting machine. However steelmaking, in this method has created new problems. That is, the vacuum-degassing procedure involves a problem in that the desired [C] content of the steel must be ensured within as short a time as possible in order to compete with the operating capability of the subsequent continuous-casting procedure. In other words, the degassing time is apt to not be satisfactory enough to ensure a desired [C] content of the steel. Moreover, although the continuous-cast slab has not large segregation of carbon, as is the case in the steel ingot-casting process, it involves a problem in that the [C] content of the steel at the starting material, i.e., the stab stage exceeds the desired value, e.g., 0.0030%, irregardless of the fact that the desired [C] content was ensured in the degassing procedure.

DISCLOSURE OF THE INVENTION

An object of the present invention is to eliminate the above-mentioned difficulties in the production of steel for an electrical steel sheet in accordance with a process comprising an continuous-casting procedure.

The gist of the present invention resides in a process for producing steel for an electrical steel sheet, the process comprising subjecting molten iron to refining, vacuum-degassing, and continuous-casting procedures to obtain a slab, characterized in that molten steel tapped from a steelmaking furnace is placed in a vacuum-degassing apparatus equipped with a means for blowing a gas into the molten steel; the molten steel is transferred to a degassing treatment to reduce the ultimate degree of vacuum in the degassing apparatus to 1.0 mm Hg or less while blowing an inert gas into the molten steel at a rate of from 30 to 150 Nl/min per gas-blowing orifice so as to reduce the [C] content of the molten steel to 0.0030% or less; adjusting of the steel chemistry is carried out by adding silicon or a silicon-containing alloy or any other alloying component to the decarburized molten steel in such an amount that the silicon content of the molten steel is in a range of from 1.0% to 3.5% and thereby molten steel for a non-oriented silicon-steel sheet is prepared; and the resultant molten steel is subjected to continuous casting by using means for continuous casting having a carbon content of 3.0% or less, said means being: a means contacting the melt, such as a melt-receiving vessel, and a melt-supplying agent apparatus; an agent contacting the melt, such as a heat insulating for melt; and a casting powder to be put on the surface of the moltent steel in continuous casting mold. The ultimate degree of vacuum means the degree of vacuum at the final stage of degassing.

The present invention provides a process for producing steel for an electrical steel sheet which is capable not only of reducing the [C] content of molten steel to a desired value within an extremely short period of degassing, as compared with the conventional method, but also of suppressing an increase in the [C] content of molten steel during continuous casting so as to maintain the carbon content of a strand at the desired value.

The present invention is illustrated in detail below.

The inventors of the present invention made various studies and analyses regarding the vacuum-degassing procedure and the continuous-casting procedure prior to the completion of this invention. As a result, the inventors of the present invention acquired the following information:

1. With regard to the relationship between the ultimate degree of vacuum in a vacuum-degassing apparatus (as an example, reference is made to a DH vacuum-degassing apparatus) and the [C] content of molten steel at the completion of degassing, it was observed that the [C] content at the completion of degassing tend to be concentrated at a value of 30 ppm (0.003%) or less, which is a desired carbon range when the ultimate degree of vacuum in the apparatus is 1.0 mm Hg or less.

Figure 1:
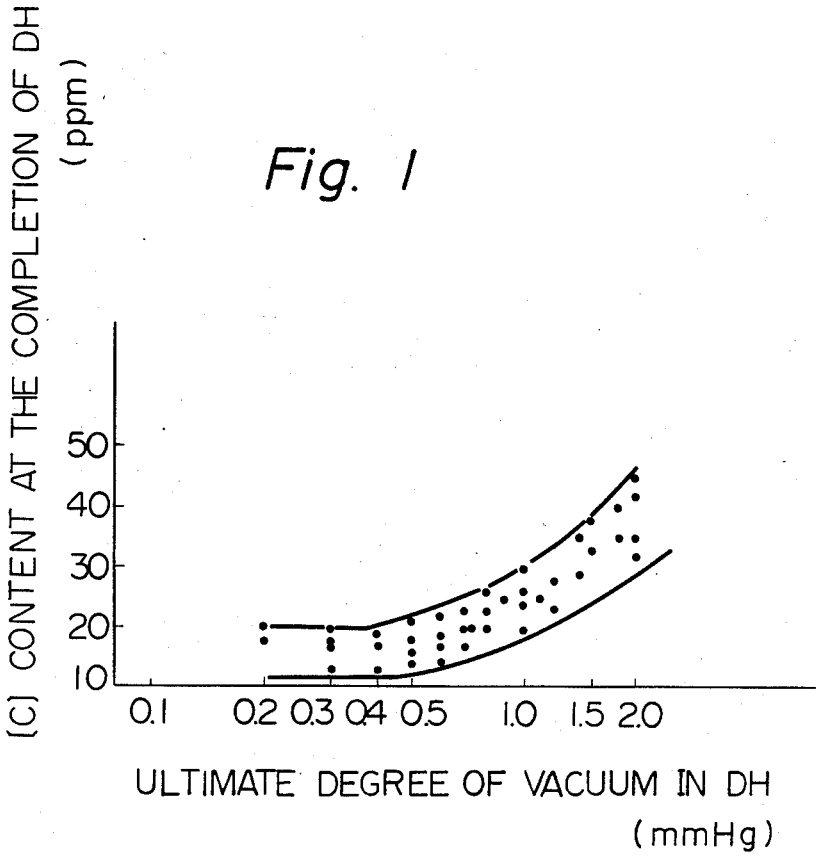
FIG. 1 is a graph illustrating the relationship between the ultimate degree of vacuum in a DH vacuum-degassing apparatus and the [C] content of molten steel at the completion of degassing.

On the other hand, in the case where the ultimate degree of vacuum in the apparatus exceeds 2.0 mm Hg the [C] content at the completion of degassing is liable to exceed the desired range (FIG. 1).

This tendency shown in FIG. 1 is conspicuous when the total rate of inert gas blown is 700 Nl/min.

2. With regard to the dependence of the decarburization rate on the rate of argon gas blown into non-degassed molten steel in the DH vacuum-degassing apparatus, an optimal decarburization rate to attain a desired [C] value can be maintained when the rate of argon gas blown is 700 Nl/min, preferably from 200 to 700 Nl/min.

Figure 2:
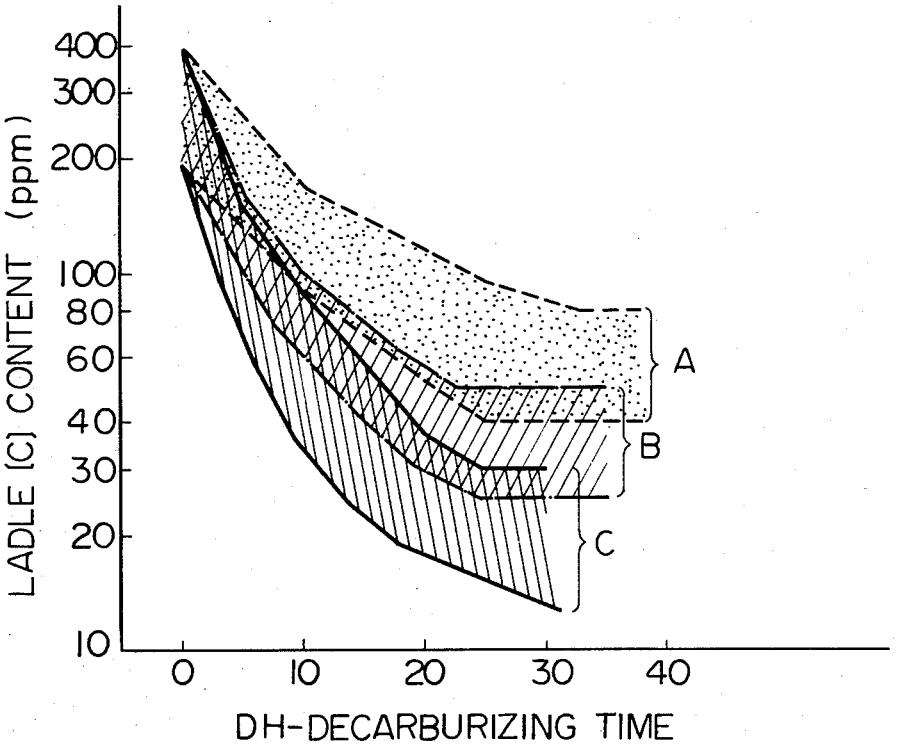
FIG. 2 is a graph illustrating the relationship between the [C] content and the DH-decarubrizing time when argon gas is blown into the DH vacuum-degassing apparatus.
Figure 3:
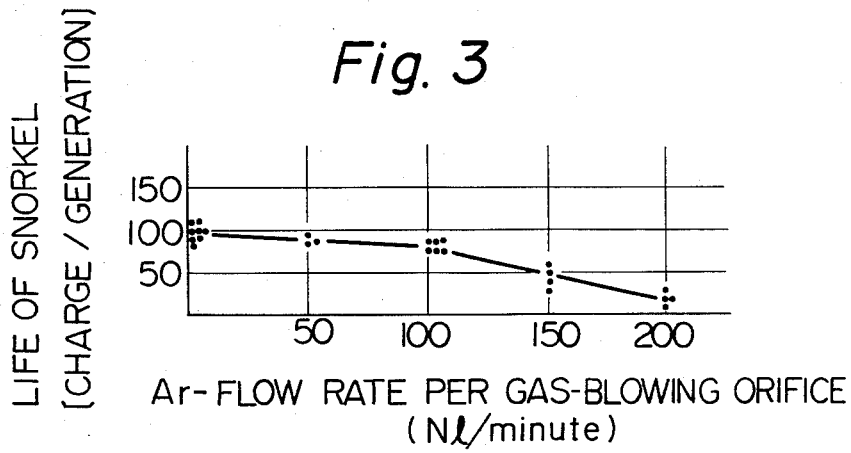
FIG. 3 is a graph illustrating the relationship between the rate of inert gas blown per gas-blowing orifice and the life of a snorkel (suction pipe).

Referring to FIG. 2, the symbol A represents a case where no argon gas is blown, and the symbols B and C represent cases where argon gas is blown at a rate of from 100 to 200 Nl/min and from 500 to 700 Nl/min, respectively.

3. With regard to the relationship between the life of a snorkel and the rate of argon gas blown per gas-blowing orifice, the rate of argon gas blown per gas blowing orifice is preferably 100 Nl/minute or more.

Moreover, it was found that the refractories, agents and powder directly in contact with the molten steel during continuous casting causes the degassed molten steel to pick up carbon during continuous casting, thereby causing the [C] content to increase.

A. The shaped refractories of a melt-receiving vessel such as a tundish.

B. The shaped refractories of a melt-supplying means, such as a long nozzle for supplying the melt from the ladle to the tundish or an immersion nozzle for supplying the melt from the tundish to the mold.

C. A heat-insulating agent (material) for preventing heat loss from the surface of molten steel. This agent is applied on the molten steel placed in the tundish.

D. The powder which is applied on the molten steel poured in a continuous casting mold, i.e., a mold lubricant capable of isolating the melt from the atmosphere (i.e., capable of preventing the melt from being oxidized).

In addition to the above-mentioned factors A through D, a ferroalloy, such as ferrosilicon, which is added into the degassed molten steel may be a reason why carbon is picked up. In order to avoid this disadvantage, it is necessary to add an alloying component in the form of an element, such as metallic silicon, or to add extremely low-carbon alloys, such as high purity Fe-Si, such addition resulting in an increase in the production cost of a slab. In view of this, the prevention of carbon pick up due to the above-mentioned factors A through D was investigated.

In the present invention, on the basis of the above-mentioned information 1 through 3, the vacuum-degassing procedure is carried out under such operating conditions that the ultimate degree of vacuum in the vacuum-degassing apparatus is 1.0 mm Hg or less and the rate of inert gas, such as argon gas, blown through a gas-blowing orifice (generally, a gas-blowing pipe) provided in a snorkel (suction pipe) of the vacuum-degassing apparatus, e.g., a DH vacuum-degassing apparatus, is in a range of from 30 to 150 Nl/min, preferably from 30 to 100 Nl/min, per gas-blowing orifice, hereby the [C] content of the molten steel is reduced to 0.0030% or less at the completion of the degassing procedure. The pattern in which an inert gas is blown may be suitably selected from the following two methods: a method in which the rate of inert gas blown is increased and decreased in accordance with the ascent and descent of the vacuum vessel and a method in which the rate of inert gas blown is constant (unchanged).

On the other hand, an example of the carbon content of a lining refractory for a tundish, a heat-insulating material for a tundish, and a powder to be added to the interior of the mold, each containing a carbon source which is a cause of carbon pickup during the continuous-casting procedure, is indicated in Table 1.

TABLE 1

| Cause of Carbon Pickup | Refractory of Tundish | | Heat-Insulating Agent of Tundish | | Powder To Be Added to Interior of Mold | | Long Nozzle and Immersion Nozzle | |
|---|---|---|---|---|---|---|---|---|
| Grade (Type) | Board | Coating | Fired Rice Hull | Carbon-free Powder | Low Carbon Product | Carbon-free Product | Alumina-Graphite Type | Fired Silica |
| Carbon Content | 3% | 0.2% or less | 51% | 0.2% or less | 3% | 0.2% or less | 30% | 1.0% |

As shown in Table 1, the materials of alumina-graphite refractories and fused silica refractories are used as shaped refractories, such as a long nozzle or an immersion nozzle. From the viewpoint of the suppression of carbon pick up, it is advantageous to use a nozzle made from a fused silica refractory whose carbon content is so very low that it is substantially negligible.

Also, the amount of carbon picked up during continuous casting and the ratio of the number of acceptable slabs having a carbon content of 30 ppm or less to the entire number of produced slabs are indicated in Table 2.

TABLE 2

| | Conventional Method | Present Invention Test 1 | Test 2 | Test 3 | Test 4 |
|---|---|---|---|---|---|
| Refractory of Tundish | Board | Board | Board | Coating | Coating |
| Heat-Insulating | Fired Rice Hull | Carbon-free | Cabon-free | Carbon-free | Carbon-free |
| Agent of Tundish | | Product | Product | Product | Product |
| Mold Powder | Low Carbon Product | Low Carbon | Carbon-free | Low Carbon | Carbon-free |
| | | Product | Product | Product | Product |
| Amount of Carbon Pickup (ppm) | 11 | 9 | 4 | 4 | 0 |
| Acceptable Slab with Carbon Content of 30 ppm or Less, (%) | 0 | 50~70 | 70~90 | 70~90 | 100 |

In the tests of the present invention, a fused silica-type immersion nozzle for continuous casting was used. In Tables 1 and 2, the board is a well-known shaped refractory product in the form of a plate which is conventionally used as a lining material for a tundish.

The term "coating" signifies a MgO coating applied on the surface of a refractory-lining material.

In the case of a heat-insulating material for a tundish, the term "carbon-free product" signifies a heat-insulating material having a carbon content of 0.2 wt % or less and containing substantially no carbonaceous material, for example, a commercially available L.C.P. (Low Carbon Powder).

In the case of a continuous casting mold powder, the term "low carbon product" signifies a so-called low carbon powder having a carbon content of 3 wt % or less, for example, a powder product commercially available under the trade name of CNS-15SE. Also, in the case of a continuous casting mold powder, the term "carbon-free product" signifies a carbon-free powder having a carbon content of 0.2 wt % or less and which can be considered to be substantially free of carbon, e.g., a powder product commercially available under the name of DIACON-S6.

As is apparent from Table 2, the amount of carbon picked up by the molten steel can be controlled so that it does not exceed 10 ppm, preferably 5 ppm, by weight of the molten steel by selecting an appropriate combination of the lining refractory for a tundish, the heat-insulating material for the melt in the tundish, and the additive powder for the mold. The results of Table 2 indicate that the entire amount of carbon picked up after the vacuum-degassing procedure can be controlled so that is does not exceed 10 ppm, sometimes 5 ppm or less, depending on the above-mentioned combination.

The meaning of the numerical values of the present invention concerning the ultimate degree of vacuum in a degassing vessel and the like is illustrated hereunder.

In the present invention, the ultimate degree of vacuum in the degassing vessel of the vacuum-degassing apparatus is limited to 1.0 mmHg or less. If the ultimate degree of vacuum exceeds 1.0 mmHg, the [C] content at the completion of degassing tends to be more than 0.0030%. Also, the rate of inert gas blown per gas-blowing orifice is limited to a range of from 30 to 150 Nl/min. If the rate of inert gas blown per gas-blowing orifice is less than 30 Nl/min, the molten steel enters the gas-blowing orifice, causing clogging of the blowing nozzle. Therefore, a gas rate of at least 30 Nl/min is necessary for preventing the molten steel from entering the orifice. On the other hand, the blowing of an inert gas at a rate exceeding 150 Nl/min causes the lining refractory of the snorkel (suction pipe) to remarkably erode due to the action of groups of bubbles generated by the blown gas, thereby shortening the life of the snorkel.

Moreover, the shaped material (agent) in contact with the molten steel, such as a lining refractory for a melt-receiving vessel, and the continuous casting mold powder should, respectively, have a carbon content of 3% or less. When the carbon content exceeds 3%, even if the [C] content of the molten steel can be reduced to 0.0030% or less at the completion of degassing, the [C] content of the degassing molten steel tends to exceed the desired maximum value of 0.0030% during the continuous-casting procedure. Therefore, there is a great possibility that decarburization-annealing will be necessary at a stage subsequent to hot-rolling, as is the case with the conventional method.

The practice of the present invention having the construction described above makes it possible not only to allow the [C] content of molten steel to reach a desired value within an extremely short degassing treatment time, as compared with the conventional art, but also to suppress an increase in the [C] content of the degassed molten steel during the continuous-casting procedure, thereby keeping the carbon content of the resultant slab at the desired value. Accordingly, the present invention is greatly advantageous in that decarburization-annealing subsequent to hot-rolling or cold-rolling can be omitted.

THE BEST FORM OF CARRYING OUT THE INVENTION

The production of steel for an electrical steel sheet by utilizing the present invention having the construction described above is illustrated.

Molten iron is first refined in a steelmaking furnace, e.g., a converter. The undeoxidized molten steel tapped from the furnace into a melt receiving ladle is transferred into a vacuum-degassing apparatus, such as a DH vacuum-degassing apparatus. Molten steel is sucked into the DH vacuum-degassing apparatus through the snorkel. During vacuum treatment inert gas, such as argon is blown into the molten steel through a pipe fitted on the snorkel.

The pressure of the degassing vessel of the degassing apparatus is reduced so that the ultimate degree of vacuum at a level of 1.0 mmHg or less is attained. The blowing of the inert gas is carried out in such a pattern that the entire rate of the inert gas blown is blown at four levels, 200 Nl/min, 300 Nl/min, 500 Nl/min, and 700 Nl/min; the rate of argon gas blown per gas-blowing orifice is in a range of from 30 to 150 Nl/min; a maximum rate, e.g., 150 Nl/min, per gas-blowing orifice of argon gas is blown into the molten steel when the vacuum-degassing apparatus sucks the molten steel from the ladle; and a minimum rate of 30 Nl/min per gas-blowing orifice of argon gas is blown into the molten steel when the molten steel is returned from the vacuum-degassing apparatus to the ladle. The preferable maximum and minimum flow rates are 100 Nl/min and 30 Nl/min, respectively. Combinations of the refractory for the tundish, the heat-insulating material for the molten steel in the tundish, and the additive powder for the mold, selected in accordance with the entire rate of argon gas blown, the final chemical composition of the molten steel, and the DH degassing time, are collectively shown in Table 3.

TABLE 3

| | Rate of Ar Gas Blown Through DH Snorkel (Nl/min) | DH Decarburizing Time | Lining Refractory of Tundish | Heat-Insulating Material for Tundish | Additive Powder for CC Mold | Nozzle* Between Ladle and Tundish (Long Nozzle) | Nozzle* Between Tundish and Mold (Immersion Nozzle) | Chemical Composition** C % | Si % | Al % |
|---|---|---|---|---|---|---|---|---|---|---|
| Conventional Method 1 | 0 | 28 | Board | Baked Rice Hull | Low Carbon Powder | Fused Silica | Fused Silica | 0.0063 | 2.96 | 0.335 |
| Conventional Method 2 | 0 | 27 | " | Carbon-free Powder | Low Carbon Powder | " | " | 0.0045 | 2.89 | 0.329 |
| Example 1 | 200 | 25 | Broad | Baked Rice Hull | Low Carbon Powder | " | " | 0.0035 | 2.53 | 0.317 |
| Example 2 | 200 | 25 | " | Carbon-free Powder | Low Carbon Powder | " | " | 0.0028 | 2.86 | 0.336 |
| Example 3 | 300 | 25 | " | Baked Rice Hull | Low Carbon Powder | " | " | 0.0033 | 3.01 | 0.673 |
| Example 4 | 300 | 25 | " | Carbon-free Powder | Low Carbon Powder | " | " | 0.0025 | 3.05 | 0.668 |
| Example 5 | 500 | 25 | " | Carbon-free Powder | Low Carbon Powder | " | " | 0.0029 | 2.93 | 0.453 |
| Example 6 | 500 | 25 | " | Carbon-free Powder | Carbon-free Powder | " | " | 0.0026 | 2.88 | 0.426 |
| Example 7 | 500 | 25 | Coating | Carbon-free Powder | Low Carbon Powder | " | " | 0.0027 | 2.90 | 0.452 |
| Example 8 | 500 | 25 | " | Carbon-free Powder | Carbon-free Powder | " | " | 0.0023 | 2.95 | 0.433 |
| Example 9 | 700 | 23 | Board | Carbon-free Powder | Low Carbon Powder | " | " | 0.0027 | 3.09 | 0.685 |
| Example 10 | 700 | 23 | " | Carbon-free Powder | Carbon-free Powder | " | " | 0.0025 | 3.15 | 0.733 |
| Example 11 | 700 | 23 | Coating | Carbon-free Powder | Low Carbon Powder | " | " | 0.0024 | 3.07 | 0.718 |
| Example 12 | 700 | 20 | " | Carbon-free Powder | Carbon-free Powder | " | " | 0.0020 | 3.13 | 0.697 |

*The nozzle is made of a fused silica-type material.

**Molten steel having a silicon content of from 1.0% to 2.50% is not described in the Examples because the influence of the carbon value of the ferroalloy added to the molten steel in the DH vacuum-degassing apparatus is less than that in the above-mentioned Examples. When the entire rate of argon gas blown is of the level of Example 12 of Table 3 in the present invention, most preferable results are obtained as in Table 2. As is apparent from Table 3, the degassing time of Example 12 is from 7 to 8 minutes shorter than that of the Comparative Examples, in which argon-gas blowing was not carried out, indicating that the degassing of the present invention was completed within an extremely short period of time.

INDUSTRIAL UTILITY

The process of the present invention is utilized in an iron mill provided with a degassing apparatus and a continuous-casting apparatus for the purpose of producing an electrical steel sheet.

We claim:

1. A process for producing steel having 0.0030% or less of C, for an electrical steel sheet, comprising the steps of:

(1) tapping molten steel from a steelmaking furnace, and transferring it to a vacuum-degassing apparatus equipped with a means for blowing a gas into the molten steel;

(2) subjecting the molten steel to a degassing treatment including reducing the ultimate degree of vacuum in said degassing apparatus to 1.0 mmHg or less while blowing an inert gas into the molten steel at a rate of from 30 to 150 Nl/min per gas-blowing orifice so as to reduce the carbon content of the molten steel to 0.0030% or less;

(3) adding silicon, a silicon-containing alloy or an alloying component to the decarburized molten steel in an amount such that the silicon content in the molten steel is in a range of from 1.0% to 3.5% and thereby preparing molten steel for a non-oriented silicon steel sheet;

(4) in order to subject the resultant molten steel to continuous casting, bringing said molten metal into contact with a melt-receiving vessel, a melt-supplying apparatus, and a heat-insulating agent for the melt; and (5) applying a casting powder onto the surface of the molten steel in a continuous casting mold, "the carbon content of each of said melt-receiving vessel, melt-supplying apparatus, heat-insulating agent, and casting powder being 3.0% or less."

2. A process as claimed in claim 1, wherein the amount of carbon picked up by the molten steel during the continuous-casting procedure is controlled so that it does not exceed 10 ppm, preferably 5 ppm.

3. A process as claimed in claim 1, wherein the rate of inert gas blown per gas-blowing orifice is in a range of from 30 to 100 Nl/min.

4. A process as claimed in claim 2, wherein the amount of carbon picked up by the molten steel does not exceed 5 ppm.

* * * * *

UNITED STATES PATENT AND TRADEMARK OFFICE

CERTIFICATE OF CORRECTION

PATENT NO. : 4,555,264

DATED : November 26, 1985

INVENTOR(S) : TAKESHITA et al

It is certified that error appears in the above-identified patent and that said Letters Patent is hereby corrected as shown below:

Priority Data Omitted. Should read:

--Application No. PCT/JP81/00203, filed in Japan on August 28, 1981--

Signed and Sealed this

*Twelfth* Day of *August 1986*

[SEAL]

*Attest:*

DONALD J. QUIGG

*Attesting Officer*

*Commissioner of Patents and Trademarks*